US009437986B2

(12) United States Patent
Knauer et al.

(10) Patent No.: US 9,437,986 B2
(45) Date of Patent: Sep. 6, 2016

(54) SHOCKLESS PLUG AND SOCKET ASSEMBLY FOR SAFE INTERCONNECTION OF LIVE CIRCUITS

(71) Applicant: ConnectDER, Falls Church, VA (US)

(72) Inventors: Jon Knauer, Falls Church, VA (US); John Schroeder, Falls Church, VA (US); Al Iaconangelo, Falls Church, VA (US); Josh Konstantinos, Falls Church, VA (US); Ben Lewis, Falls Church, VA (US); Adam Koeppel, Falls Church, VA (US); Whit Fulton, Falls Church, VA (US)

(73) Assignee: ConnectDER LLC, Falls Church, VA (US)

( * ) Notice: Subject to any disclaimer, the term of this patent is extended or adjusted under 35 U.S.C. 154(b) by 0 days.

(21) Appl. No.: 14/709,718

(22) Filed: May 12, 2015

(65) Prior Publication Data

US 2016/0020561 A1 Jan. 21, 2016

Related U.S. Application Data

(60) Provisional application No. 61/991,786, filed on May 12, 2014.

(51) Int. Cl.

| | |
|---|---|
| ***H01R 13/66*** | (2006.01) |
| ***H01R 13/713*** | (2006.01) |
| ***H01R 13/53*** | (2006.01) |
| *H01R 105/00* | (2006.01) |
| *H01R 13/621* | (2006.01) |
| *H01R 13/684* | (2011.01) |

(52) U.S. Cl.

CPC ..... *H01R 13/7135* (2013.01); *H01R 13/53* (2013.01); *H01R 13/6215* (2013.01); *H01R 13/684* (2013.01); *H01R 2105/00* (2013.01)

(58) Field of Classification Search

CPC H01R 13/68; H01R 13/688; H01R 13/6666; H01R 9/245; H01R 13/66; H01R 25/006; H01R 31/08; H01R 13/502; H01R 13/696

See application file for complete search history.

(56) References Cited

U.S. PATENT DOCUMENTS

| | | | | | |
|---|---|---|---|---|---|
| 4,758,184 | A * | 7/1988 | Call | H01R 13/68 | 337/197 |
| 5,320,563 | A * | 6/1994 | Liao | H01R 13/68 | 439/620.34 |
| 5,451,173 | A * | 9/1995 | Mai | H01R 13/68 | 439/620.29 |
| 5,637,017 | A * | 6/1997 | Hsu | H01R 13/68 | 337/198 |

* cited by examiner

*Primary Examiner* — Xuong Chung Trans

(74) *Attorney, Agent, or Firm* — Brundidge & Stanger, P.C.

(57) ABSTRACT

Technologies are generally described for a socket, plug, and jumper system. In an example, a receptacle socket includes a first prong receptacle for a ground circuit, a second prong receptacle for a neutral circuit, and a third prong receptacle for an active voltage circuit. A plug housing includes a first prong contact corresponding to the first prong receptacle for the ground circuit, a second prong contact corresponding to the second prong receptacle for the neutral circuit, and a fourth prong receptacle for the active voltage circuit. A jumper component includes a third prong contact corresponding to the third prong receptacle for the active voltage circuit, and a fourth prong contact corresponding to the fourth prong receptacle for the active voltage circuit, wherein the fourth prong contact is completely recessed within the jumper component.

14 Claims, 14 Drawing Sheets

SHOCKLESS PLUG AND SOCKET ASSEMBLY FOR SAFE INTERCONNECTION OF LIVE CIRCUITS

BACKGROUND

When creating connections between two or more electrical circuits, it is important to protect the person making the connection from risk of electrical shock. The time and cost of wiring electrical circuits together is often alleviated by adopting a plug and socket approach, wherein each of the electric circuits is connected via wiring into a plug or a socket adapter, and then the two are mounted together and unmounted as needed. The circuit carrying active voltage is typically attached to the socket, which is recessed and "touch safe", thereby minimizing the risk of electric shock. The circuit meant to receive active voltage while mounted is attached to the plug. During the initial wiring of the plug and socket to their respective circuits, safety for the person performing the work is typically ensured by taking precautions to ensure that both of the circuits are not carrying active voltage before carrying out any work.

However, in some situations, such as when electrical generation equipment is connected to a power distribution network, both of the two electrical circuits may be energized with active voltage. It is often not feasible to shut down the distribution grid and the electrical generation equipment. When it is feasible, shutting down either the electrical generation equipment or the distribution grid requires additional time and work, as well as an abundance of caution from workers to ensure the electrical circuits are off, which slows down work further. A common problem when connecting two potentially live circuits using a plug and socket approach is that the plug adapter must necessarily expose one of the live circuits to contact by a person, thereby exposing the risk of electric shock.

SUMMARY

A socket, plug, and jumper system provides the ability to safely connect multiple circuits together even when the circuits are connected to live voltage. In an example, a receptacle socket includes a first prong receptacle for a ground circuit, a second prong receptacle for a neutral circuit, and a third prong receptacle for an active voltage circuit. A plug housing includes a first prong contact corresponding to the first prong receptacle for the ground circuit, a second prong contact corresponding to the second prong receptacle for the neutral circuit, and a fourth prong receptacle for the active voltage circuit. A jumper component includes a third prong contact corresponding to the third prong receptacle for the active voltage circuit, and a fourth prong contact corresponding to the fourth prong receptacle for the active voltage circuit, wherein the fourth prong contact is completely recessed within the jumper component.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of this disclosure will become more fully apparent from the following description and appended claims, taken in conjunction with the accompanying drawings. Further, understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1:
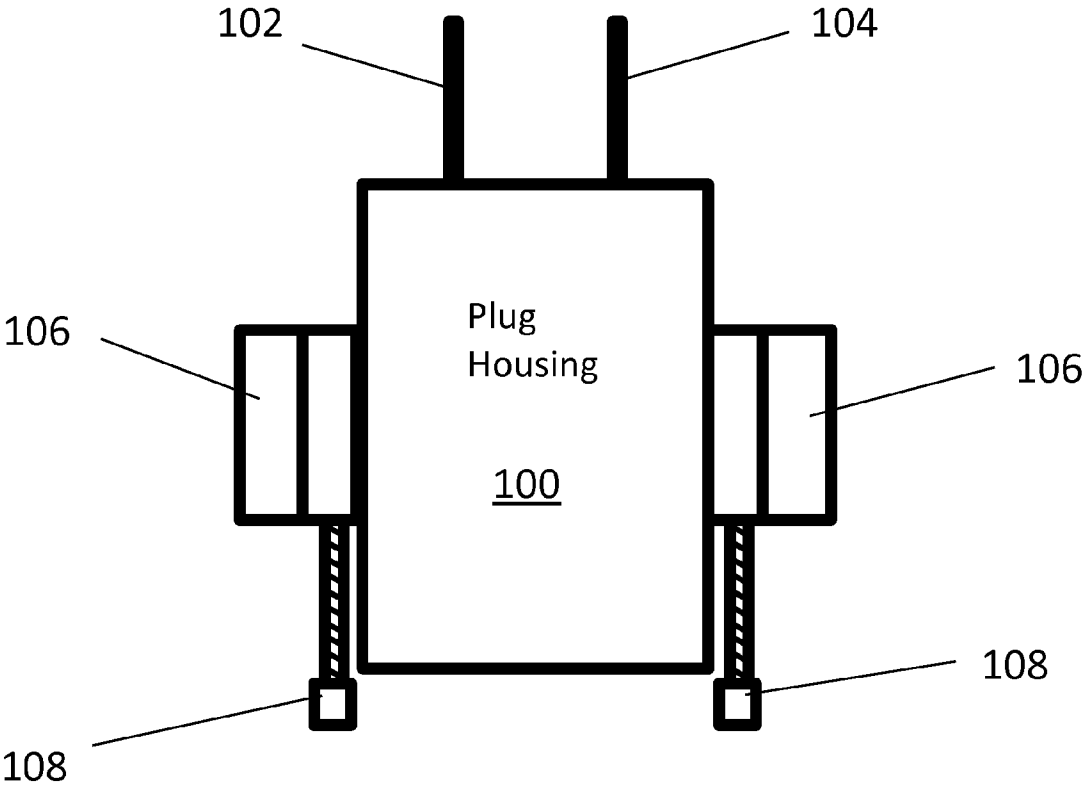
FIG. 1 shows a top view of an exemplary plug housing exposing prong contacts for the ground and neutral electrical circuits corresponding to those in a receptacle socket.

In the following detailed description, reference is made to the accompanying drawings, which form a part of the description. In the drawings, similar symbols typically identify similar components, unless context dictates otherwise. Furthermore, unless otherwise noted, the description of each successive drawing may reference features from one or more of the previous drawings to provide clearer context and a more substantive explanation of the current example embodiment. Still, the example embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein and illustrated in the drawings, may be arranged, substituted, combined, separated, and designed in a wide variety of different configurations, all of which are explicitly contemplated herein.

This disclosure is generally drawn to a socket, plug, and jumper system that, when used together, provides the ability to safely connect multiple circuits together even when the circuits are connected to live voltage, while providing overcurrent protection to the connected circuits. The socket, plug, and jumper system also provides the ability to safely disengage the circuits while the circuits are connected to live voltage (e.g., "break under load"). In addition, the socket, plug, and jumper system may also provide the ability to connect a data transfer circuit as well. At no time in the connection or disconnection process is an electrical contact that is connected to live voltage exposed to anyone working on the system.

For example, the interconnection process may include the following steps. A plug housing may be mounted to the receptacle socket to engage the contacts for the ground and neutral circuits. Note, however, that the active voltage circuits are not completed and are not capable of passing energy across the connection. Only the ground and neutral circuits are complete. The plug housing may then be affixed to the receptacle socket using a securing apparatus such as screws. The jumper component may then be simultaneously mounted to the receptacle socket and a secondary receptacle socket in the rear of the plug housing, thereby completing the active voltage circuits and enabling energy to flow across the connection.

FIG. 1 shows a top view of an exemplary plug housing 100 exposing prong contacts 102 and 104 for ground and neutral electrical circuits, respectively. A sponson 106 on each side of the plug housing 100 contains means to securely attach electrical wiring or conduit carrying electrical wiring to the plug housing 100. Captive screws 108 fulfill the dual purpose of securing the plug housing 100 into a receptacle, and also ensuring that a jumper component cannot be attached to the plug housing 100 before it is inserted and secured to a receptacle.

Figure 2:
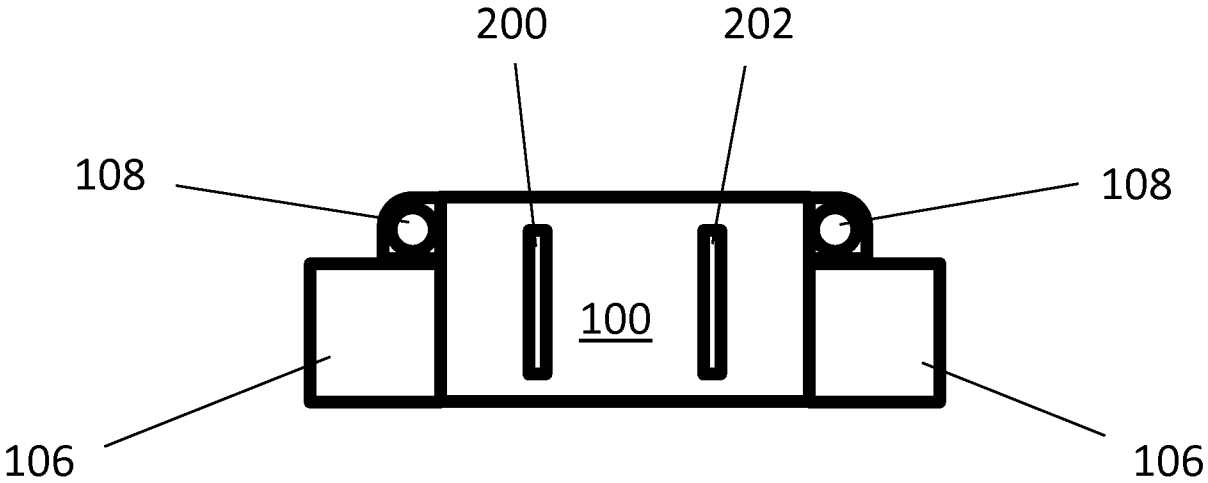
FIG. 2 shows a rear view of an exemplary plug housing exposing prong contacts for the ground and neutral electrical circuits corresponding to those in a receptacle socket.

FIG. 2 shows a rear view of the exemplary plug housing 100 exposing prong receptacles 200 and 202 for circuits carrying active electrical voltage. These prong receptacles 200 and 202 are electrically connected to electrical wiring or conduit carrying electrical wiring via an access hole in the sponson 106. The sponson 106 on each side of the plug housing 100 contains means to securely attach electrical wiring or conduit carrying electrical wiring to the plug housing 100. Captive screws 108 fulfill the dual purpose of securing the plug housing 100 into a receptacle, and also ensuring that a jumper component cannot be attached to the plug housing 100 before it is inserted and secured to a receptacle. The placement of the captive screws 108 may be asymmetrical to ensure that the plug housing 100 cannot be secured to a receptacle upside down.

Figure 3:
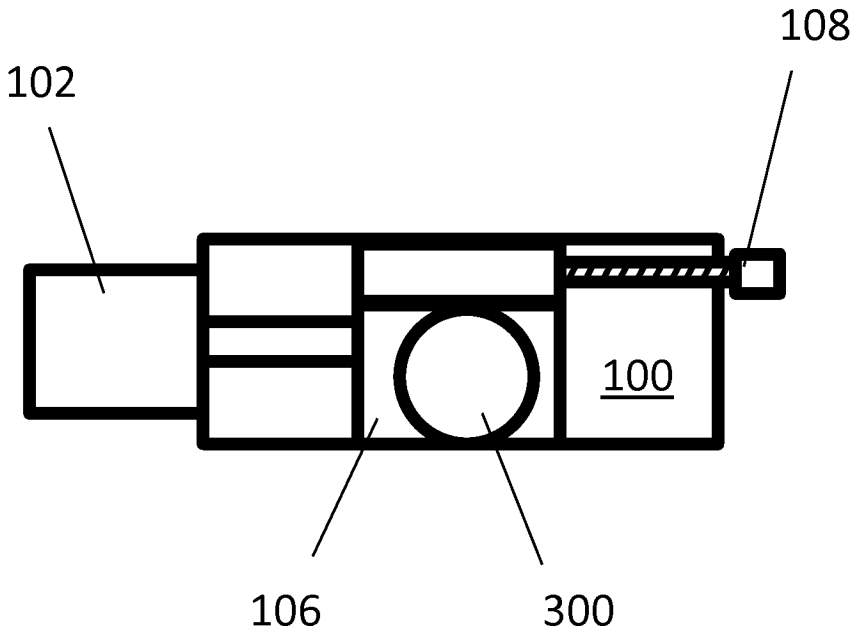
FIG. 3 shows a side view of an exemplary plug housing exposing prong contacts for the ground and neutral electrical circuits corresponding to those in a receptacle socket.

FIG. 3 shows a side view of the exemplary plug housing 100 exposing prong contact 102 for the ground electrical circuit. The neutral electrical circuit prong 104 is not visible in this view. An access hole 300 in the sponson 106 on each side of the plug housing 100 contains means to securely attach electrical wiring or conduit carrying electrical wiring to the plug housing 100. Captive screw 108 fulfills the dual purpose of securing the plug housing 100 into a receptacle, and also ensuring that a jumper component cannot be attached to the plug housing 100 before it is inserted and secured to a receptacle.

Figure 4:
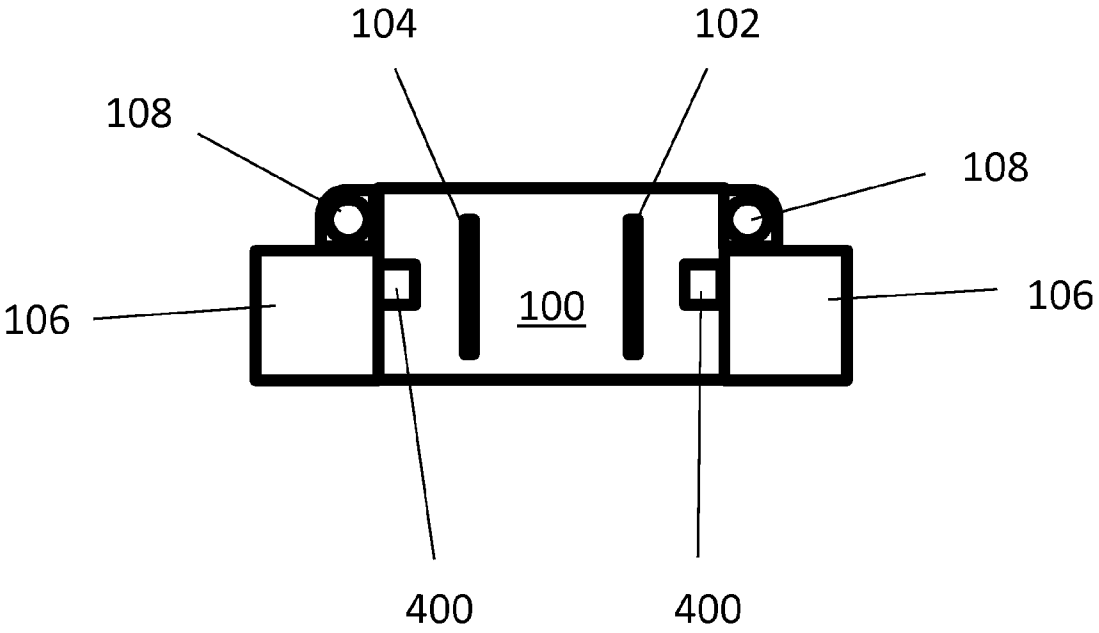
FIG. 4 shows a front view of an exemplary plug housing exposing prong contacts for the ground and neutral electrical circuits corresponding to those in a receptacle socket.

FIG. 4 shows a front view of the exemplary plug housing 100 exposing prong contacts 102 and 104 for the ground and neutral electrical circuits, respectively. The sponson 106 on each side of the plug housing 100 contains means to securely attach electrical wiring or conduit carrying electrical wiring to the plug housing 100. Captive screw 108 fulfills the dual purpose of securing the plug housing 100 into a receptacle, and also ensuring that a jumper component cannot be attached to the plug housing 100 before it is inserted and secured to a receptacle. Guide slots 400 on the plug housing 100 ensure that only the plug housing 100 and not the jumper component can be inserted into the appropriate part of the receptacle.

Figure 5:
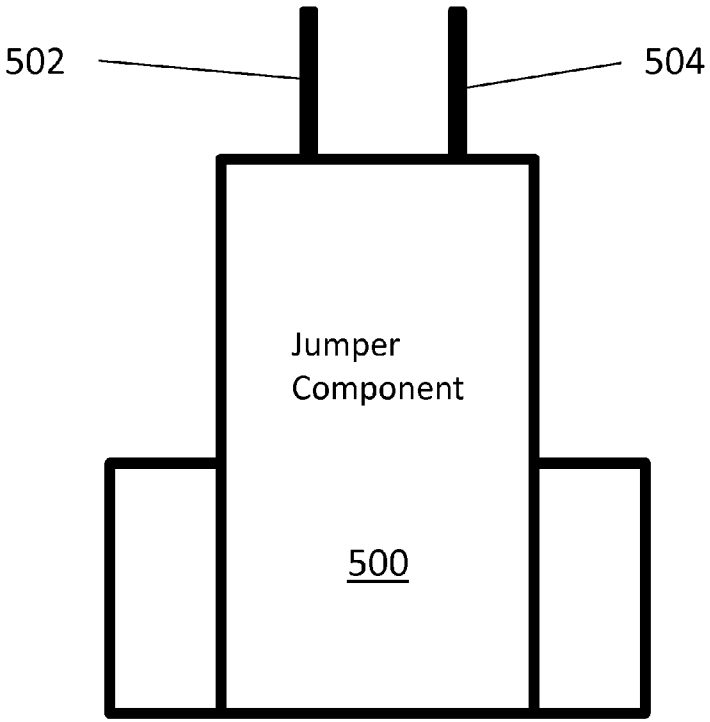
FIG. 5 shows a top view of an exemplary jumper component exposing prong contacts for the circuits carrying active electrical voltage and incorporating overcurrent protection technology.

FIG. 5 shows a top view of an exemplary jumper component 500 exposing prong contacts 502 and 504 for the circuits carrying active electrical voltage.

Figure 6:
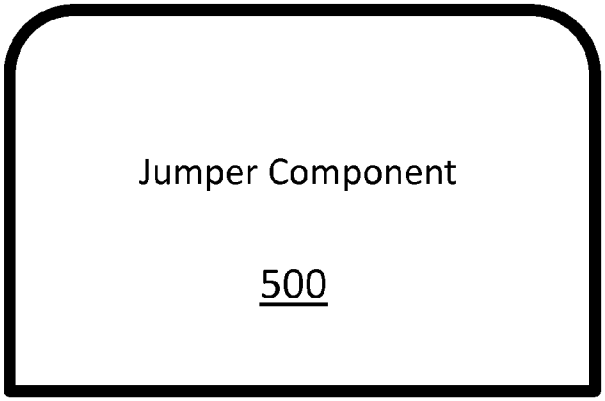
FIG. 6 shows a rear view of an exemplary jumper component exposing prong contacts for the circuits carrying active electrical voltage and incorporating overcurrent protection technology.

FIG. 6 shows a rear view of the exemplary jumper component 500.

Figure 7:
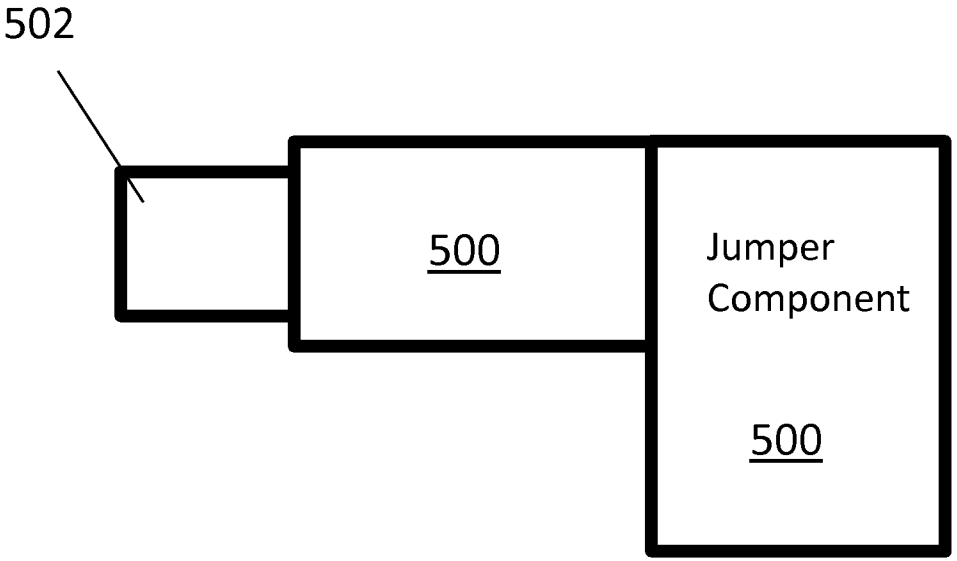
FIG. 7 shows a side view of an exemplary jumper component exposing prong contacts for the circuits carrying active electrical voltage and incorporating overcurrent protection technology.

FIG. 7 shows a side view of the exemplary jumper component 500 exposing prong contact 502 for a circuit carrying active electrical voltage.

Figure 8:
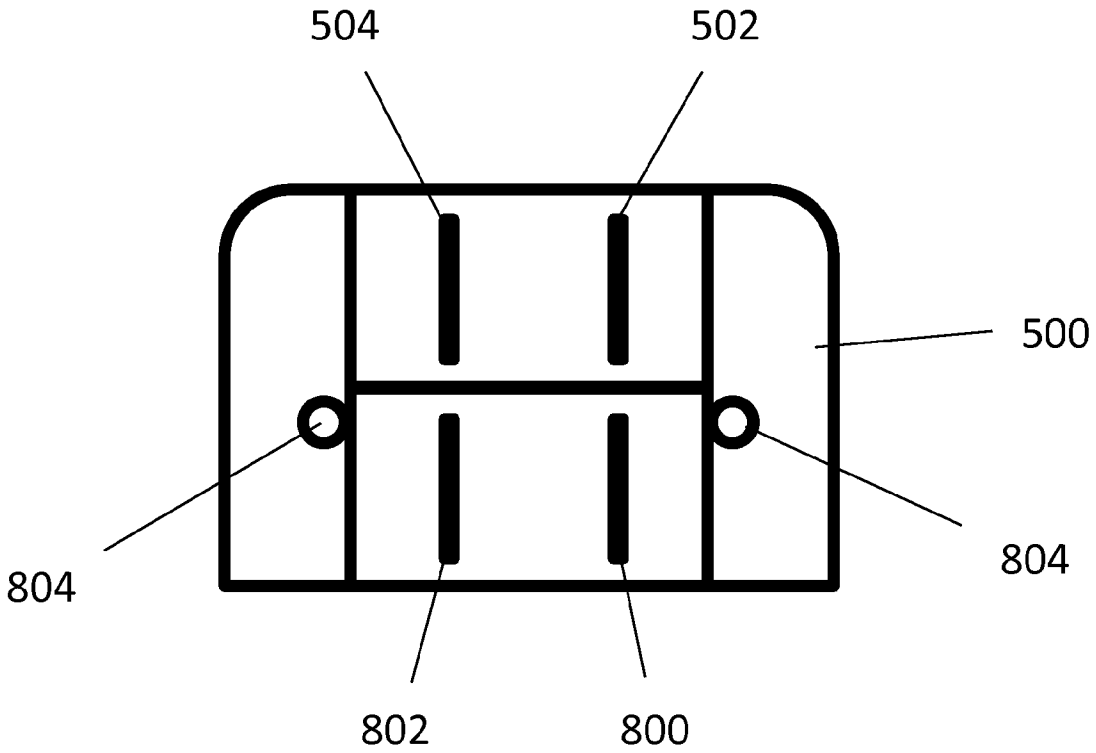
FIG. 8 shows a front view of an exemplary jumper component exposing prong contacts for the circuits carrying active electrical voltage and incorporating overcurrent protection technology.

FIG. 8 shows a front view of the exemplary jumper component 500 exposing prong contacts 502, 504, 800, and 802 for the circuits carrying active electrical voltage. Prong contacts 800 and 802 are not visible in previous figures depicting the jumper component 500 as they are recessed in a well inside the jumper component to reduce or eliminate the possibility of an installer's hand or digits coming into contact during the insertion of jumper component 500 into the plug housing 100 installed in a receptacle. Small receptacles 804 for captive screw heads 108 allow the jumper component 500 to install onto the plug housing 100 only when the plug housing has been secured to a receptacle.

Figure 9:
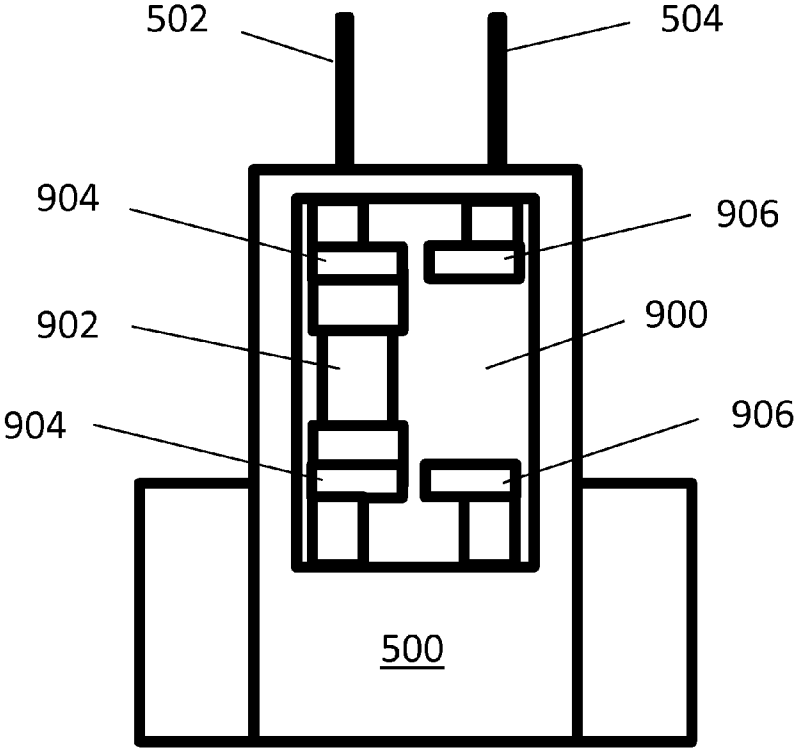
FIG. 9 shows a top view of an exemplary jumper component exposing prong contacts for the circuits carrying active electrical voltage and incorporating overcurrent protection technology, with the access panel for the overcurrent protection open.

FIG. 9 is similar to FIG. 5, and shows a top view of the exemplary jumper component 500 exposing prong contacts 502 and 504 for the circuits carrying active electrical voltage. The cover of the cavity 900 that holds overcurrent protection fuses has been removed. A fuse 902 is held by fuse holders 904 and is electrically connected to prong contact 502, as well as its corresponding non-visible recessed prong contact 800. Fuse holder 906 does not contain a fuse, and is connected to prong contact 504 as well as its corresponding non-visible recessed prong contact 802.

Figure 10:
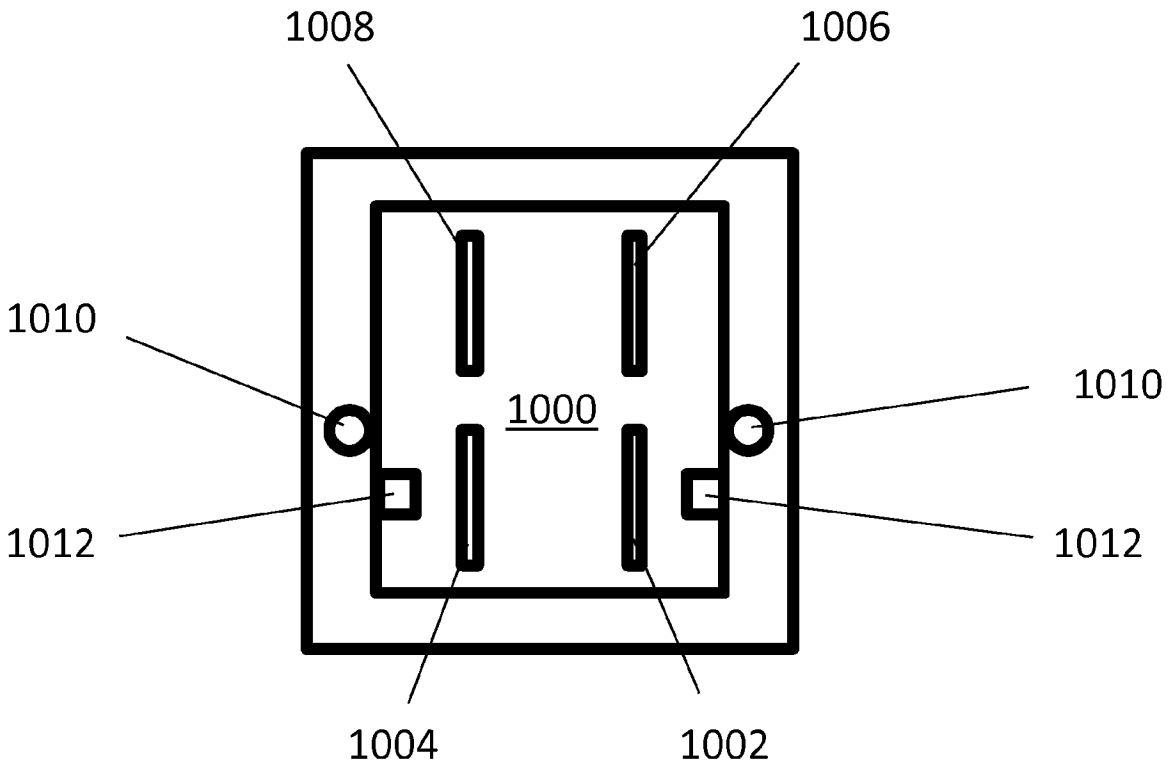
FIG. 10 shows a front view of an exemplary primary receptacle socket enclosing contacts for the following electrical circuits: an electrical neutral wire, an electrical ground wire, and one or more wires carrying active electrical voltage.

FIG. 10 shows a front view of an exemplary primary receptacle socket 1000 enclosing contacts for the following electrical circuits: an electrical neutral wire 1002, an electrical ground wire 1004, and contacts 1006 and 1008 for carrying active electrical voltage. Screw holes 1010 allow the captive screws 108 on the plug housing 100 to be secured to the receptacle socket 1000. Guide bars 1012 in the receptacle socket 1000 allow only the plug housing 100 to be inserted into the lower half of the receptacle socket 1000.

Figure 11:
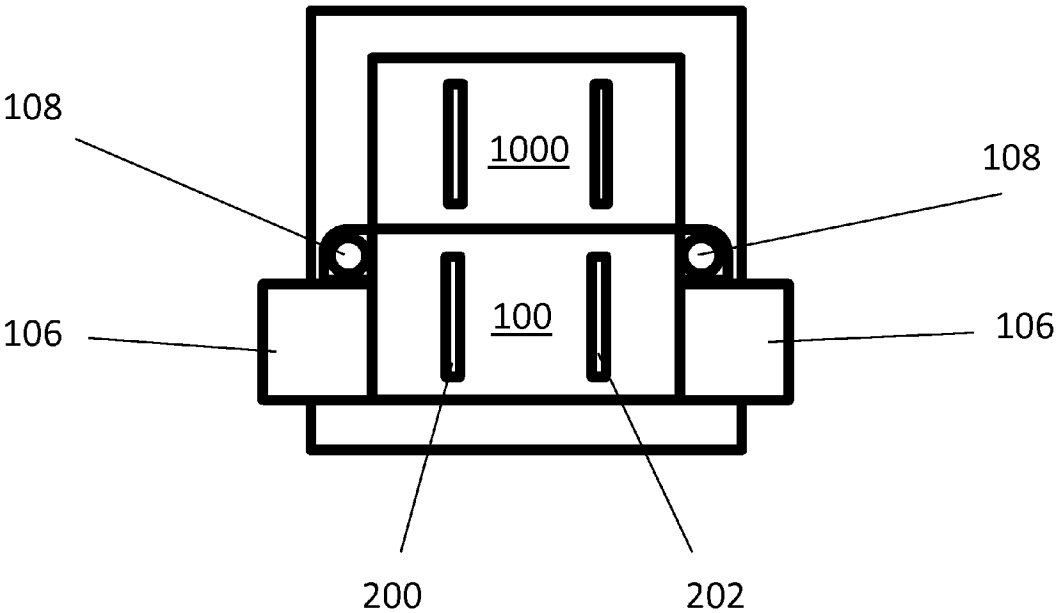
FIG. 11 shows a front view of an exemplary primary receptacle socket with a plug housing inserted.

FIG. 11 shows a front view of the exemplary primary receptacle socket 1000 with the plug housing 100 installed. Captive screws 108 have secured the plug housing 100 to the receptacle socket 1000. The ground and neutral prong contacts on the plug housing 100 have made electrical contact with their respective prong receptacles in the receptacle socket 1000 ensuring the whole assembly will be properly grounded before any active electrical voltage is connected. The two prong contacts 200 and 202 for the electrical circuit carrying active electrical voltage are visible on the rear of the plug housing 100. As depicted any ground and neutral wires connected via the access holes 300 in the sponsons 106 to the plug housing 100 are connected to ground and neutral. Any wires carrying active electrical voltage and connected to the plug housing 100 are electrically connected to the jumper component prong receptacles 200 and 202. The jumper component prong receptacles 200 and 202 are recessed so that even while energized, the installer's hand or digits cannot come into contact with active electrical voltage carrying circuits.

Figure 12:
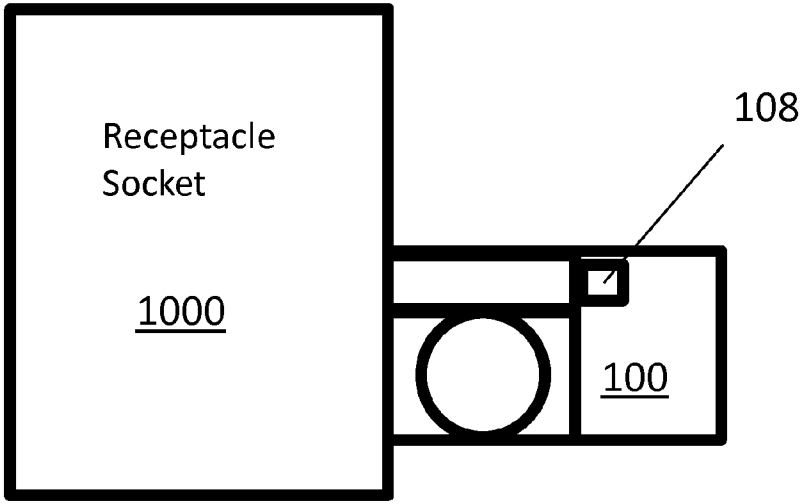
FIG. 12 shows a side view of an exemplary primary receptacle socket with a plug housing inserted.

FIG. 12 shows a side view of the exemplary primary receptacle socket 1000 with the plug housing 100 installed. Captive screws 108 have secured the plug housing 100 to the receptacle socket 1000.

Figure 13:
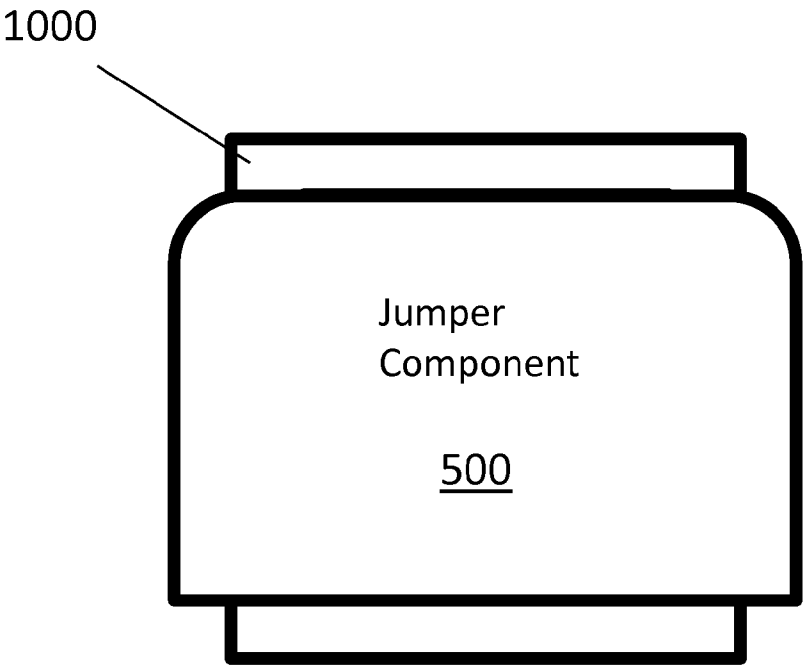
FIG. 13 shows a front view of an exemplary primary receptacle socket with a plug housing and jumper component inserted.

FIG. 13 shows a front view of the exemplary primary receptacle socket 1000 with the plug housing 100 installed, although not visible, and jumper component 500 inserted into the plug housing 100 and the receptacle socket 1000 completing all electrical circuits.

Figure 14:
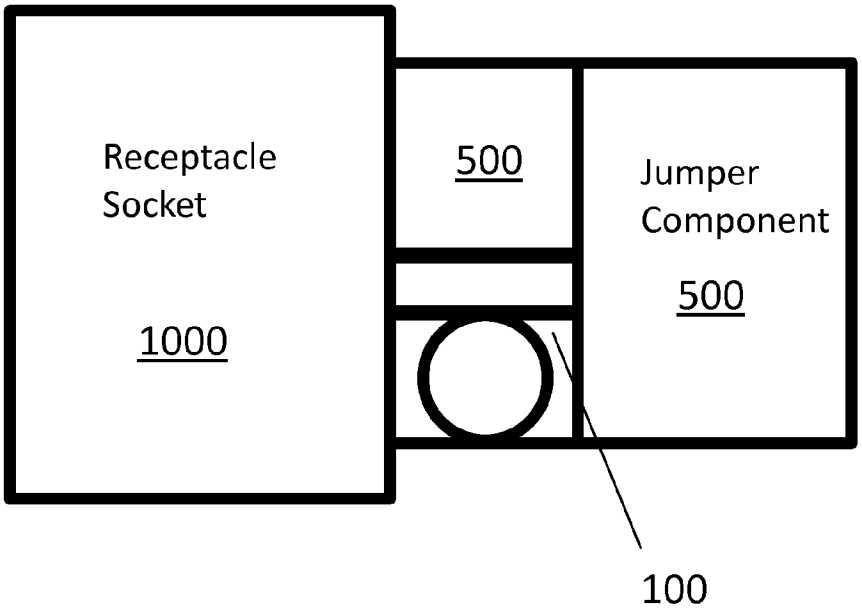
FIG. 14 shows a side view of an exemplary primary receptacle socket with a plug housing and jumper component inserted.

FIG. 14 shows a side view of the exemplary primary receptacle socket 1000 with the plug housing 100 and jumper component 500 inserted. All electrical circuits are connected. If the circuits carrying active electrical voltage in the primary receptacle socket 1000 need to be disconnected from the circuits carrying active electrical voltage in the plug housing 100 or any wires connected to the plug housing 100, the jumper component 500 may be manually removed without tools by withdrawing it from the primary receptacle socket 1000. This will leave the ground and neutral electrical circuits still connected, and will also reveal only electrical prong receptacles on the primary receptacle socket 1000 and plug housing 100 that are recessed so that even while energized, the installer's hand or digits cannot come into contact with active electrical voltage carrying circuits.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. A system, comprising:

a receptacle socket including:

a first prong receptacle for a ground circuit, a second prong receptacle for a neutral circuit, and a third prong receptacle for an active voltage circuit;

a plug housing including:

a first prong contact corresponding to the first prong receptacle for the ground circuit, a second prong contact corresponding to the second prong receptacle for the neutral circuit, and a fourth prong receptacle for the active voltage circuit; and a jumper component including:

a third prong contact corresponding to the third prong receptacle for the active voltage circuit, and a fourth prong contact corresponding to the fourth prong receptacle for the active voltage circuit, wherein the fourth prong contact is completely recessed within the jumper component.

2. The system of claim 1, wherein when the first and second prong contacts of the plug housing are inserted into the first and second prong receptacles of the receptacle socket, respectively, connections for the ground and neutral circuits are connected without connecting any connections for the active voltage circuit.

3. The system of claim 2, wherein when the third and fourth prong contacts of the jumper component are inserted into the third prong receptacle of the receptacle socket and the fourth prong receptacle of the plug housing, respectively, connections for the active voltage circuit are connected.

4. The system of claim 1, wherein the receptacle socket further includes at least one guide bar, and wherein the plug housing further includes at least one guide slot corresponding to the at least one guide bar of the receptacle socket for ensuring that only the first and second prong contacts of the plug housing can be inserted into the first and second prong receptacles of the receptacle socket, respectively.

5. The system of claim 1, wherein the receptacle socket further includes at least one screw hole, and wherein the plug housing further includes at least one captive screw corresponding to the at least one screw hole of the receptacle socket for securing the plug housing to the receptacle socket.

6. The system of claim 5 wherein the placement of the at least one screw hole and the at least one captive screw is asymmetrical to ensure that the plug housing cannot be secured to the receptacle socket upside down.

7. The system of claim 5, wherein the at least one captive screw is of sufficient length to prevent the insertion of the fourth prong contact of the jumper component into the fourth prong receptacle of the plug housing until the plug housing is fully secured to the receptacle socket.

8. The system of claim 1, wherein the plug housing further includes at least one access hole to allow electrical wiring to enter the plug housing for electrical connection to the first and second prong contacts and the fourth prong receptacle.

9. The system of claim 1, wherein the jumper component further includes overcurrent protection circuitry.

10. The system of claim 9, wherein the overcurrent protection circuitry includes a fuse.

11. The system of claim 9, wherein the overcurrent protection circuitry includes a circuit breaker.

12. The system of claim 1, wherein the receptacle socket and the plug housing further include corresponding contacts for a data transfer connection.

13. The system of claim 1, wherein the receptacle socket is mounted in an electric meter collar.

14. The system of claim 13, wherein the plug housing and jumper component are used to connect a distributed energy system to the electric meter collar.

* * * * *